US006582057B2

(12) United States Patent
Suzuki

(10) Patent No.: US 6,582,057 B2
(45) Date of Patent: Jun. 24, 2003

(54) INK JET PRINTER HEAD AND METHOD FOR MANUFACTURING THE SAME

(75) Inventor: Isao Suzuki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/012,862

(22) Filed: Oct. 22, 2001

(65) Prior Publication Data

US 2003/0076382 A1 Apr. 24, 2003

(51) Int. Cl.[7] ..... B41J 2/135; B41J 2/045

(52) U.S. Cl. ..... 347/44; 347/68; 347/69; 347/70; 347/71

(58) Field of Search ..... 347/44, 45, 68–71; 216/27; 29/890.1

(56) References Cited

U.S. PATENT DOCUMENTS 5,475,407 A * 12/1995 Ohashi ..... 347/69
6,329,671 B1 * 12/2001 Tamaki et al. ..... 257/48
6,423,241 B1 * 7/2002 Yoon et al. ..... 216/27

FOREIGN PATENT DOCUMENTS

JP 8-52872 A 2/1996
JP 408052872 A * 2/1996 ..... 347/68
JP 8-290569 A 11/1996
JP 10-291318 A 11/1998

OTHER PUBLICATIONS

Related application: 09/887,432; filed Jun. 25, 2001; M. Shimosato et al; Ink Jet Printer Head and Method for Manfuacturing the Same.

* cited by examiner

*Primary Examiner*—John Barlow
*Assistant Examiner*—An H. Do
(74) *Attorney, Agent, or Firm*—Frishauf, Holtz, Goodman & Chick, P.C.

(57) ABSTRACT

An ink-jet printer head includes a main body which is provided with a plurality of pressure chambers to which ink is supplied and a nozzle which is provided for each pressure chamber to cause the pressure chamber to communicate with the outside, and whose portion is formed from a piezoelectric material. In each pressure chamber, an electrode for applying a voltage to the piezoelectric material is provided to change the volume of the pressure chamber. A surface of the electrode is coated with an insulating film to electrically insulate the electrode from the ink, and the surface of the insulating film is partially or entirely coated with a metal film.

10 Claims, 2 Drawing Sheets

INK JET PRINTER HEAD AND METHOD FOR MANUFACTURING THE SAME

BACKGROUND OF THE INVENTION

The present invention relates to an ink-jet printer head where conductive ink such as, for example, aqueous ink can be used and a method for manufacturing the same.

Conventionally, an ink-jet printer head which comprises a plurality of pressure chambers at least one portions of which are respectively formed of a piezoelectric material, a nozzle formed for each pressure chamber, and a voltage application means for the piezoelectric material, where an ink droplet is ejected from the nozzle by shear mode deformation of the piezoelectric material generated by applying a voltage to the piezoelectric material by the voltage application means has been known.

In Jpn. Pat. Appln. KOKAI Publication No. 8-52872, there has been disclosed an ink-jet printer head where an insulating film such as a parylene film is formed on an inner surface of an electrode inside a pressure chamber by CVD process or the like in order to prevent ink from deteriorating due to current flowing in the ink. According to the technology disclosed in the publication, driving voltage of the pressure chamber is electrically insulated from the ink by the insulating film so that, even when electrically-conductive ink is used, current can be prevented from flowing in the ink, thereby preventing the ink from deteriorating. According to the technology disclosed in the publication, it becomes possible to form an even film on a stacked piezoelectric member having a complex and fine shape such as an inner surface of the pressure chamber of the ink-jet printer head by forming an insulating film such as a parylene film by CVD process.

In Jpn. Pat. Appln. KOKAI Publication No. 8-290569, in order to improve stability and durability of a piezoelectric material, there has been disclosed an ink jet printer head where a voltage is applied to an electrode which is mounted on the piezoelectric material and whose portion to be inserted in the pressure chamber is over-coated with polyimide resin by spin coating process to display the piezoelectric material to a direction of a nozzle, so that ink is ejected from the nozzle. According to the technology disclosed in-the publication, ink is prevented from permeating the piezoelectric material by the polyimide resin so that the stability and durability of the piezoelectric material can be improved.

In Jpn. Pat. Appln. KOKAI Publication No. 10-291318, there has been disclosed such a technology that, in a nozzle formation, after a pressure chamber is attached with a plate, a nozzle is formed in the plate by irradiating the plate locally with an eximer laser or the like so that an ink jet printer head with excellent ink ejection performance can be provided. In this technology, when a nozzle is formed, such an organic film as a parylene film or a polyimide film is damaged by such laser light or beam as an eximer laser beam in the ultraviolet-range thereof, so that a portion of an electrode corresponding to the damaged portion of the film is directly exposed in the pressure chamber via the damaged portion. For this reason, since the insulation between the ink and the electrode is damaged, it becomes impossible to use electrically-conductive ink.

BRIEF SUMMARY OF THE INVENTION

An object of the invention is to provide an ink-jet printer head where, when electrically-conductive ink such as aqueous ink is used, inconvenience such as degradation of the ink is not caused and an excellent ink ejection can be achieved, and a method for manufacturing the same.

An ink-jet printer head according to an aspect of the present invention comprises: a main body which has a plurality of pressure chambers to which ink is supplied, and a nozzle which is provided for each pressure chamber to cause the pressure chamber and the outside to communicate with each other, and whose portion is formed of a piezoelectric material;

- an electrode which is provided in each pressure chamber and which applies a voltage to the piezoelectric material so as to change the volume of the pressure chamber to eject the ink via the nozzle;
- an insulating film which covers a surface of the electrode in order to electrically insulate the electrode from the ink; and
- a metal film which covers at least a portion of the insulating film which is in the pressure chamber and is near to the nozzle.

In such a head, the surface of the electrode exposed in the pressure chamber is covered with the insulating film to be electrically insulated from the ink. Therefore, even when electrically-conductive ink is used, the ink is prevented from degrading by current flowing in the ink. In this insulating film, a surface thereof which is near the nozzle and which may be irradiated by a laser beam for nozzle formation is protected by the metal film, not to, for example, be damaged by irradiation by the laser beam for forming the nozzle. This metal film does not cover the whole surface of the insulating film necessarily, but it may cover only a portion of the insulating film which is damaged easily, for example, a portion thereof which is in the vicinity of the nozzle. However, when the insulating film is formed of a material with poor chemical resistance, it is preferable that the entire surface of the insulating film be covered with the metal film. As a result, the insulating film can be prevented from being damaged by chemicals such as detergent in a cleaning material the insulating film has excellent chemical. When resistance, this metal film is not necessarily required to remain in a final product.

It is preferable that the insulating film be obtained by forming a film of an organic polymer material such as polyimide, polyurea, polyimide-amide, polyamide and/or polyazo-methylene by a deposition-polymerization process in view of adhesion with an electrode and resistance to ink and detergent. Particularly, when the insulating film is formed from polyurea, the temperature at which polymerization starts can be sufficiently reduced to the extent that polarization degradation of the piezoelectric material does not occur, so that it is made possible to cover the electrode with the film without degrading the performance of the piezoelectric material. Instead, when the insulating film is formed with polyimide, productivity can be improved because high-speed film formation can be achieved and polyimide is inexpensive. However, since polyimide has a high film formation temperature, it can be used effectively when heat-resistant PZT which is not degraded at a high temperature or the like is used as the piezoelectric material.

It is preferable that the metal film have a higher reflectivity because the insulating film can be protected from the laser beam. It is more preferable that the metal film have a reflectivity of 30% or more because a sufficient protective effect can be achieved even when the metal film is made thinner.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

An embodiment of the present invention will be explained with reference to FIGS. 1 to 3. The embodiment shows an example where the present-invention is applied to an ink-jet printer head where electrically-conductive ink can be used.

Figure 1:
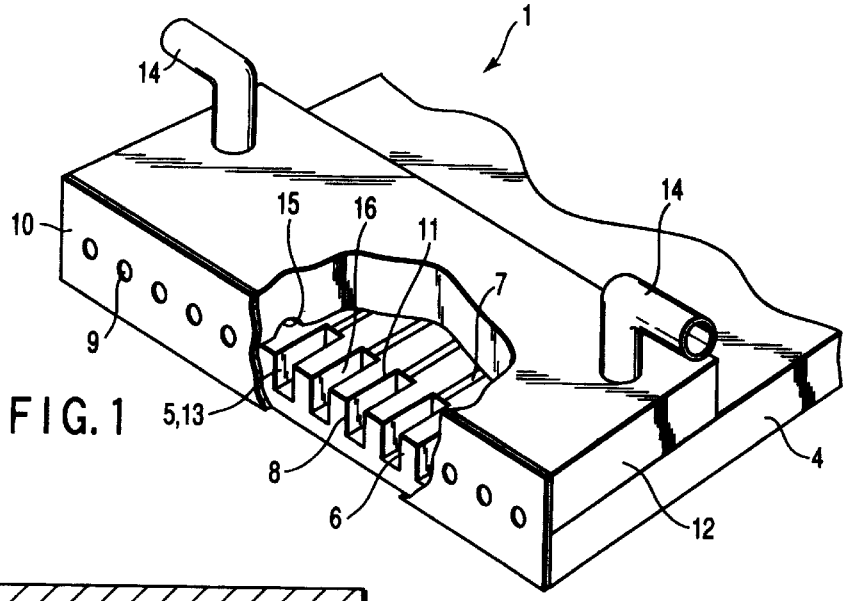
FIG. 1 is a perspective view showing an ink-jet printer head of an embodiment of the present invention in a partially exploded manner.
Figure 2:
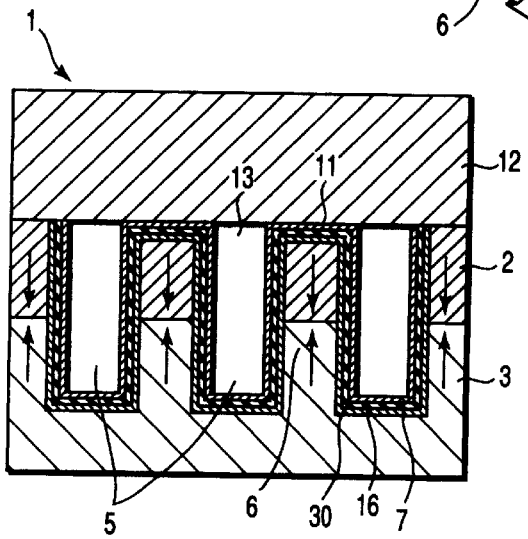
FIG. 2 is a sectional view showing a portion of the ink-jet printer head of the embodiment of the invention which is taken at a position perpendicular to a groove extending direction.

FIG. 1 is a perspective view showing an ink-jet printer head of the embodiment of the invention in an partially exploded manner, and FIG. 2 is a sectional view showing a portion of the ink-jet printer head of the embodiment of the invention which is taken at a position perpendicular to a groove extending direction. An ink-jet printer head 1 has a stacked piezoelectric material or member 4 which is formed by stacking two sheets of flat piezoelectric materials 2, 3 made of a piezoelectric material such as PZT. Polarization directions of the piezoelectric materials 2, 3 in the stacked piezoelectric material 4 are opposed to each other along the thickness direction of the material 4 as shown with arrows in FIG. 2.

A plurality of grooves 5 whose upper sides and front sides are opened and which extend in a horizontal direction or front and rear directions are formed in the stacked piezoelectric material 4 such that they are parallel to one another with spacing from one another at predetermined intervals (such that each groove is positioned between a pair of struts 6). The grooves comprise groove portions formed on an upper face of the lower-side piezoelectric material 3 and slot portions which are formed in the upper-side piezoelectric material 2 to correspond to these groove portions. The grooves 5 can be obtained by cutting with a diamond wheel used in die sawing or the like. Adjacent grooves are mutually partitioned from one another by the strut portion 6 of the piezoelectric material 4. In this embodiment, each groove 5 is constituted with a rectangular groove whose depth is in a range of 0.2 to 1 mm, whose width is in a range of 20 to 200 $\mu$m, and whose length is in a range of 0.5 to 500 mm, but the groove employed is not limited to such dimensions or such a shape in this invention.

A plurality of electrodes 7 formed by a non-electrolytic nickel plating process are provided on the inner surfaces of the grooves 5 and an upper face of the stacked piezoelectric material 4 over their entire surfaces.

In the embodiment, the electrode 7 is formed from nickel, but the present invention is not limited to nickel. For example, the electrode 7 may be formed from such electrically-conductive materials as gold and copper.

Front opening portions 8 of the grooves 5 which are opened at the front-face side of the stacked piezoelectric material 4 are closed by a nozzle plate 10 formed with a plurality of nozzles 9. These nozzles 9 are formed to correspond to the respective grooves 5, i.e., each nozzle 9 is formed for each pressure chamber described later. In this embodiment, the nozzle plate 10 is formed with a thickness of about 10 to 100 $\mu$m.

Upper-side opening portions 11 of all the grooves 5 which are opened upward of the stacked piezoelectric material 4 are closed a lid member 12 formed of a metal plate. An ink supply passage 15 serving as an ink flow path communicating with ink supply pipes 14 which are caused to communicate with an ink tank (not shown) to supply ink to respective pressure chambers 13 described later is formed in the lid member 12.

In a state that the front-face opening portions 8 and the upper-side opening portions 11 of the grooves 5 are closed by the lid member 12 and the nozzle plate 10, the pressure chambers 13 are defined by the respective grooves 5. The respective pressure chambers 13 are caused to communicate with one anther via the ink supply passage 15.

An ink-jet printer head 1 is connected with cables (not shown) to a control section and a power supply. During printing, driving pulse voltages, printing signals, and the like are input to the ink-jet printer head 1.

When printing with an ink-jet printer having such an ink-jet printer head 1, one polarity voltage is applied to the electrodes 7 positioned on both sides of one or a plurality of the pressure chambers 13 that effect ink ejection in a state where all the pressure chambers 13 are filled with ink. As a result, a pair of the studs 6 corresponding to the electrodes 7 subjected to a voltage and opposed to each other via the pressure chamber are bent by a large amount in directions that enlarge the volume of the pressure chamber 13 due to share-mode deformation of the piezoelectric materials 2, 3 whose polarization directions are opposed to each other. When the polarity of the voltage applied to these electrodes 7 is reversed, the studs 6 are rapidly returned to their original or home positions. The ink in the pressure chamber 13 is pressurized while the studs 6 are being returned to their original positions so that a portion of the ink in the pressure chamber 13 is ejected as a droplet from the nozzle 9.

Figure 4A:
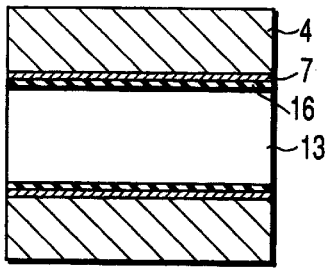
FIGS. 4A to 4E are schematic views for explaining the steps for manufacturing the ink-jet printer head of the embodiment of the invention.

When the electrodes 7 are applied with voltage in a state that electrically-conductive ink having a high conductivity such as aqueous ink fills the pressure chamber 13 in the ink-jet printer head 1, current flows in the ink filling each pressure chamber 13 via the ink filling the ink supply passage 15. Thereby, there occurs such interaction that electrolysis occurs in the ink, generating bubbles in the pressure chamber 13 or causing ink degradation, or solid material deposits on the electrode due to electrophoresis so that the electrode 7 is obstructed and presented from operating normally. In order to avoid such an inconvenience, in the ink-jet printer head 1 of this embodiment, a surface of the electrode 7 coming into contact with the ink is provided with an insulating film 16 comprising polyimide by a deposition and polymerization process (refer to FIG. 4A). Here, the deposition and polymerization process means a polymerization process where a plurality of monomers vaporized and activated by thermal energy are deposited on a base member (an electrode in this embodiment) on which to form an insulating film, and a polymerizing reaction is caused on a surface of the base member, thereby forming an organic polymer film on the surface of the base member. In this embodiment, an insulating film 16 made of polyurea has been formed, but the invention is not limited to such a material. Besides polyurea, an organic polymer film made of, for example, polyimide, polyimide-amide, polyamide, and/or polyazo-methylene, and the like can be formed.

Figure 3:
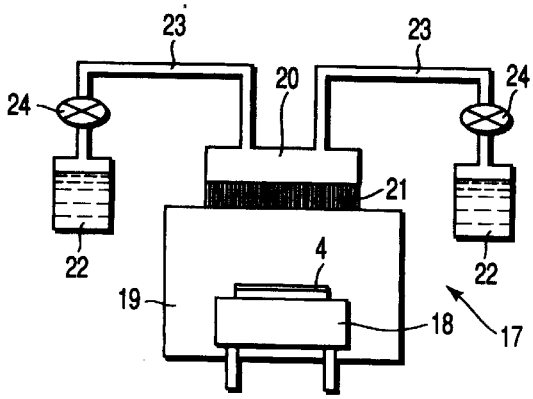
FIG. 3 is a diagram showing one example of an apparatus for performing a deposition and polymerization process.

One example where the insulating film 16 is formed by a deposition and polymerization process will be explained with reference to FIG. 3 showing a deposition and polymerization apparatus 17 schematically.

The deposition and polymerization apparatus 17 is provided with a chamber 19 having therein a stage 18 for holding a sample (the stacked piezoelectric material 4 in this embodiment) thereon to form a film by a deposition and polymerization process. Provided in the stage 18 is a temperature adjusting mechanism (not shown) for adjusting the temperature of the sample. In this embodiment, since the insulating film 16 is formed from polyurea, the temperature of the sample is maintained at room temperature. Provided within the chamber 19 is a room temperature controlling mechanism (not shown) for controlling the temperature in the chamber 19. In the present embodiment, since the insulating film 16 is formed of polyurea, the temperature in the chamber 19 is maintained in a range of a room temperature to 50° C. Provided in the chamber 19 is an unillustrated pressure-reducing mechanism for reducing pressure in the chamber 19. The pressure-reducing mechanism may employ such a mechanism where air in the chamber 19 is forcibly exhausted outside of the chamber 19, for example, as a fan. A mixing vessel 20 is provided above the chamber 19 such that it is caused to communicate with the chamber 19 via a shower plate 21 formed with a plurality of holes. The deposition and polymerization apparatus 17 is provided with two evaporating vessels 22 holding material monomer to be deposited on a sample. In this embodiment, as raw material monomers for forming the insulating film 16, 4,4-dianomiphenyl methane (MDA) and 4,4 diphenylmethane cyanate are respectively received in the evaporating vessels 22. Provided in each evaporating vessel 22 is an unillustrated heating mechanism for heating the material monomer. Also, the evaporating vessel 22 is caused to communicate with the mixing vessel 20 via a monomer introduction pipe 23. Provided in each monomer introduction pipe 23 is a valve 24 which allows the monomer introduction pipe 23 to be opened and closed. The monomer introduction pipe 23 is closed by the valve 24 except for the case where the deposition and polymerization process is conducted.

Next, the forming process of the insulating film 16 will be explained. In forming the insulating film 16, first, the stacked piezoelectric member 4 where the electrodes 7 have been formed in the inner surfaces of the grooves 5 is mounted on the stage 18 such that the opening sides of the grooves face upward. At this time, portions of the stacked piezoelectric member 4 on which the insulating film 16 is not to be formed, such as electrode 7 portions connected with flexible cables, are masked in advance. Next, the interiors of the evaporating vessels 22 are heated by the heating mechanisms to vaporize the raw material monomers. After the raw material monomers are sufficiently evaporated, the monomer introduction pipes 23 are opened by opening the valves 24. Thereby, the evaporated raw material monomers are introduced into the mixing vessel 20 via the monomer introduction pipes 23 to prepare mixed monomer comprising-various monomers substantially uniformly mixed. Prior to this processing, the pressure in the chamber 19 is reduced by the pressure-reducing mechanism. As a result, the mixed monomer is introduced into the chamber 19 via the shower plate 21 due to a pressure difference between the mixing chamber 20 and the chamber 19 to be deposited on the stacked piezoelectric member 4. At this time, the mixed monomer adhering to the surface of the stacked piezoelectric member 4 is polymerized by controlling the temperature of the stacked piezoelectric member 4 and that in the chamber 19. Therefore, the insulating film 16 made of polyurea which is a target is formed on the surface of the stacked piezoelectric member 4, namely the inner surfaces of the grooves 5 and the upper surface of the stacked piezoelectric member 4.

In the above deposition and polymerization process, since the materials to be used for film formation are deposited on the stacked piezoelectric member 4 for each monomer and these monomers are polymerized on the face of the stacked piezoelectric member 4, monomer molecules.can enter complex contours of the stacked piezoelectric member 4 in an excellent manner so that a film can be uniformly formed on the stacked piezoelectric member 4 regardless of its contours. As a result, an insulating film 16 with a sufficient thickness can be formed-over the entire exposed surfaces of the electrodes 7 formed on the inner faces of the grooves 5. Thus, even when electrically-conductive ink such as aqueous ink is used, current is prevented from pressing through the ink so that the ink-jet printer head 1 can be stably used over a long term without degradation of the ink. Also, by forming the insulating film 16 using a deposition and polymerization process producing excellent adhesion and having a satisfactory throwing power of electrolytic coloring, it becomes unnecessary to conduct ground processing on the surface of the stacked piezoelectric member 4.

Figure 4B:
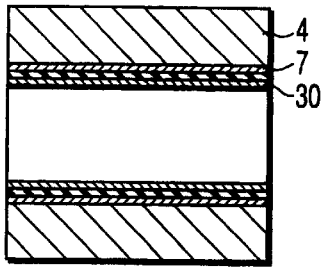

After the insulating film 16 is formed, a metal film 30 covering the entire surface of the insulating film 16 or portions thereof which are positioned near the nozzles of the pressure chambers is formed (FIG. 4B). For film formation, a sputter process or an ion plating process is employed. Metals to be used at this time may include aluminum having a high reflectivity to ultraviolet rays, aluminum (A1) alloy, nickel (Ni), and nickel alloy, but the present invention is not limited to these materials.

Figure 4C:
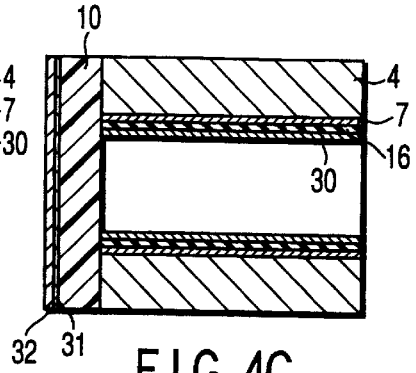

After the metal film 30 is formed, the lid member 12 is bonded to the upper surface of the stacked piezoelectric member 4 and the orifice plate 10 is bonded to the front surface of the stacked piezoelectric member 4, respectively (FIG. 4C). The orifice plate at this stage has not had nozzles formed on it yet. A polyimide film or the like which can be finely processed by an eximer laser or the like is used for the orifice plate. Next, an ink-repellent film 31 is formed on a front face of the orifice plate and a protective film 32 for protecting the ink-repellent film 31 from the laser beam described later is deposited on a surface of the ink-repellent film.

Figure 4D:
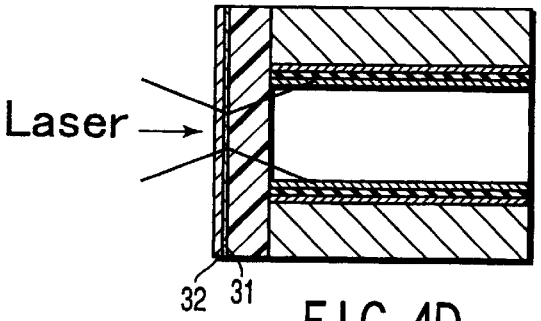
Figure 4E:
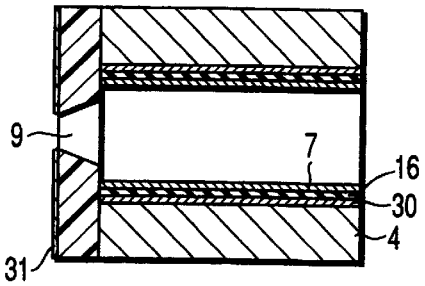

In nozzle formation, a tapered nozzle whose ejection side is small and whose pressure chamber side is large is formed by irradiation with an eximer laser beam from the front side, or the jetting port side, of the nozzle plate 10 (FIG. 4D). At this time, since the metal film 30 is formed on at least a surface of a portion of the insulating film 16 which may be damaged by the laser beam, the insulating film is prevented from being damaged by the laser beam. Thus, after the nozzle is formed, the protective film 32 is removed to complete the ink-jet printer head (FIG. 4E).

Figure 5:
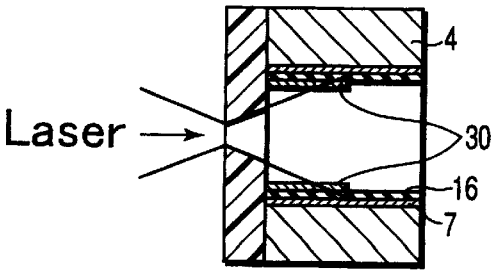
FIG. 5 is a view for explaining a modified example of a metal film of the ink-jet printer head.

In this embodiment, the insulating film 16 and the metal film 30 have been formed before the lid member 12 is attached to the stacked piezoelectric member 4, but the present invention is not limited to this order. An order can be employed in this invention such that, after the lid member is attached to the stacked piezoelectric member 4, the insulating film 16 is formed from a front face-side of the pressure chamber 13 and the metal film 30 is formed on the insulating film 16 from the opening side on the ink ejection side. In the case that the insulating film 16 is formed from a material with excellent chemical resistance, the metal film 30 to be formed is not required to be formed on the entire surface of the insulating film 16, which is different from the case shown in FIG. 5, but it may be mainly formed on a portion of the insulating film which is positioned in the vicinity of the opening portion on the ink ejection side, as shown in FIG. 5. Even in this case, since a region of the metal film to be protected from a laser beam is positioned in the vicinity of the opening portion on the ink ejection side, required functions can be met in the invention.

After nozzle formation, etching solution for removing metal is introduced into the ink chamber according to necessity to remove the metal film 30 on the insulating film formed from material with excellent chemical resistance.

In the above embodiment, the main body with the plurality of pressure chambers has been constituted by the stacked piezoelectric member, the lid member and the orifice plate, but it is not limited to such constituents in this invention. Assuming that the main body partially includes a piezoelectric material, and when a voltage is applied to the electrode, the piezoelectric material is deformed to change the volume of the pressure chamber, thereby ejecting ink from the nozzle, any material or any constituent can be employed for the main body. It is not necessarily required that the insulating film coating the electrode is a film formed by the deposition polymerization process, a so-called deposited and polymerized film, as the embodiment. The film may be formed by another process, for example, a vacuum deposition process or a plasma deposition process.

Additional advantages and modifications will readily occur to those skilled in the art. Therefore, the invention in its broader aspects is not limited to the specific details and an embodiment shown and described herein. Accordingly, various modifications may be made without departing from the spirit or scope of the general inventive concept as defined by the appended claims and their equivalents.

What is claimed is:

1. An ink-jet printer head, comprising:

a main body which has a portion formed of a piezoelectric material and which has a plurality of pressure chambers to which ink is supplied, and a plurality of nozzles which are respectively provided one for each pressure chamber to enable the pressure chambers to communicate with the outside;

a plurality of electrodes which are respectively provided one for each pressure chamber and which apply a voltage to the piezoelectric material so as to change a volume of the pressure chambers and cause the ink to be ejected via the respective nozzles;

an insulating film which covers a surface of each of the electrodes so as to electrically insulate the electrodes from the ink; and a metal film which covers at least a portion of the insulating film in the pressure chambers and near to the nozzles.

2. An ink-jet printer head according to claim 1, wherein the metal film coats a whole surface of the insulating film.

3. An ink-jet printer head according to claim 1, wherein the insulating film comprises a deposited and polymerized film formed from at least one material selected from the group consisting of polyimide, polyurea, polymide-amide, polyamide, and polyazo-methylene.

4. An ink-jet printer head-according to claim 1, wherein a reflectivity of the metal film against a laser beam is at least 30%.

5. A method for manufacturing an ink-jet printer head having a plurality of nozzles, said method comprising:

preparing a unit comprising a main body which has a portion formed from a piezoelectric material and which has a plurality of pressure chambers to which ink is supplied, and a plurality of electrodes which are respectively provided one for each pressure chamber in order to apply a voltage to the piezoelectric material to change a volume of the pressure chambers;

coating a surface of the electrodes with an insulating film in order to electrically insulate the electrodes from the ink;

forming a metal film coating at least one portion of the insulating film which is in the pressure chambers and which is positioned in a vicinity of the nozzles; and irradiating the main body externally with a laser beam to form said nozzles so as to enable each pressure chamber to communicate with the outside.

6. A method for manufacturing an ink-jet printer head according to claim 5, wherein the metal film is formed to cover a whole surface of the insulating film.

7. A method for manufacturing an ink-jet printer head according to claim 5, wherein the insulating film is formed by depositing and polymerizing on the surface of the electrodes a film consisting essentially of at least one material selected from the group of polyimide, polyurea, polyimide-amide, polyamide, and polyazo-methylene.

8. A method for manufacturing an ink-jet printer head according to claim 5, wherein the metal film has a reflectivity against a laser beam of at least 30%.

9. A method for manufacturing an ink-jet printer head comprising:

preparing a stacked piezoelectric member having a plurality of grooves in which ink is received, each of the grooves having an inner surface and at least one open end;

forming an electrode on an inner surface of each of the grooves;

coating the electrodes with an insulating film to electrically insulate the electrodes from the ink in the grooves;

forming a metal film coating at least one portion of the insulating film which is in the grooves and which is positioned near the open end of the grooves;

bonding a nozzle plate to the stacked piezoelectric member to close the open ends of the grooves; and irradiating the nozzle plate externally with a laser beam to form a plurality of nozzles in the nozzle plate so as to enable the grooves to communicate with the outside.

10. A method for manufacturing an ink-jet printer head according to claim 9, further comprising removing the metal film from the grooves after formation of the nozzles.

* * * * *